US005911508A

United States Patent [19]

Dobreski et al.

[11] Patent Number: 5,911,508

[45] Date of Patent: Jun. 15, 1999

[54] VENTED RECLOSABLE BAG

[76] Inventors: David V. Dobreski, 99 Country Downs Cir., Fairport, N.Y. 14450; Charles D. Keyser, 4611 Stanley St., Box 135, Gorham, N.Y. 14461-0135; Toby R. Thomas, 8 Kurt Rd., Pittsford, N.Y. 14534

[21] Appl. No.: 08/966,519

[22] Filed: Nov. 10, 1997

[51] Int. Cl.[6] ..... B65D 33/34

[52] U.S. Cl. ..... 383/5; 383/61; 383/63; 383/64; 383/102; 383/207

[58] Field of Search ..... 383/63, 64, 61, 383/5, 100, 101, 102, 103, 207

[56] References Cited

U.S. PATENT DOCUMENTS

| | | |
|---|---|---|
| Re. 33,674 | 8/1991 | Uramoto . |
| Re. 34,554 | 3/1994 | Ausnit . |
| 1,992,152 | 2/1935 | Yeates . |
| 2,506,311 | 5/1950 | Moore . |
| 2,560,535 | 7/1951 | Allen . |
| 2,898,027 | 8/1959 | Scholle . |
| 2,978,769 | 4/1961 | Harrah . |
| 3,104,798 | 9/1963 | Stone . |
| 3,172,443 | 3/1965 | Ausnit . |
| 3,181,583 | 5/1965 | Lingenfelter . |
| 3,198,228 | 8/1965 | Naito . |

(List continued on next page.)

FOREIGN PATENT DOCUMENTS

| | | |
|---|---|---|
| 302342 | 3/1987 | European Pat. Off. . |
| 57-105248 | 6/1982 | Japan . |
| 2130173 | 10/1983 | United Kingdom . |
| WO95/29604 | 11/1995 | WIPO . |
| WO95/35046 | 12/1995 | WIPO . |
| WO95/35047 | 12/1995 | WIPO . |
| WO95/35048 | 12/1995 | WIPO . |

OTHER PUBLICATIONS

Drawings (FIGs. 1 and 2) and Description of dog food bag, No Author. No Date.

*Primary Examiner*—Jes F. Pascua
*Attorney, Agent, or Firm*—Arnold White & Durkee

[57] ABSTRACT

A reclosable bag comprises a pair of opposing wall panels, a reclosable seal, and an optional tamper-evident partition. The pair of opposing wall panels are joined along a pair of opposing sides and a bottom bridging the opposing sides to create a receptacle space having a mouth end opposite the bottom. The reclosable seal extends along the mouth end, and includes first and second opposing reclosable elements and first and second fins extending downward from the respective reclosable elements. The reclosable elements are releasably engageable to each other. The first and second fins are connected to the respective opposing wall panels. The tamper-evident partition is located below the reclosable elements and forms a one-time breakable preferential area of weakness. The tamper-evident partition separates an interior of the bag from a first area bounded in cross-section by the tamper-evident partition, the fins, and the engaged reclosable elements. The tamper-evident partition includes first vents positioned to allow air from the interior of the bag to escape into the first area. The fins include second vents allowing air from the first area to escape to a second area outside the bag. If the tamper-evident partition is not required, the first vents are eliminated, and the second vents may be located in either the fins or the wall panels and concealed to inhibit entry of bugs into the bag via the vents.

20 Claims, 6 Drawing Sheets

U.S. PATENT DOCUMENTS 3,282,493 11/1966 Kamins et al. .
3,313,471 4/1967 Dickard et al. .
3,325,084 6/1967 Ausnit .
3,326,399 6/1967 Ausnit .
3,387,640 6/1968 Butler .
3,456,867 7/1969 Repko .
3,462,068 8/1969 Suominen .
3,471,005 10/1969 Sexstone .
3,473,589 10/1969 Gotz .
3,543,343 12/1970 Staller et al. .
3,625,270 12/1971 Skendzic .
3,633,642 1/1972 Siegel .
3,746,215 7/1973 Ausnit et al. .
3,780,781 12/1973 Uramoto .
3,991,801 11/1976 Ausnit .
4,189,050 2/1980 Jensen et al. .
4,191,230 3/1980 Ausnit .
4,196,030 4/1980 Ausnit .
4,235,653 11/1980 Ausnit .
4,241,865 12/1980 Ferrell .
4,249,982 2/1981 Ausnit .
4,252,238 2/1981 Spiegelberg et al. .
4,285,376 8/1981 Ausnit .
4,428,477 1/1984 Cristofolo .
4,518,087 5/1985 Goglio .
4,532,652 7/1985 Herrington ..... 383/63 X
4,573,203 2/1986 Peppiatt .
4,617,683 10/1986 Christoff .
4,713,839 12/1987 Peppiatt .
4,736,450 4/1988 Van Erden et al. .
4,744,674 5/1988 Nocek .
4,767,220 8/1988 Kamp ..... 383/63
4,778,282 10/1988 Borchardt et al. ..... 383/63
4,782,951 11/1988 Griesbach et al. .
4,786,190 11/1988 Van Erden et al. .
4,846,585 7/1989 Boeckmann et al. .
4,877,336 10/1989 Peppiatt .
4,923,309 5/1990 VanErden .
4,925,316 5/1990 Van Erden et al. .
5,007,142 4/1991 Herrington .
5,007,143 4/1991 Herrington .
5,010,627 4/1991 Herrington et al. .
5,020,194 6/1991 Herrington et al. .
5,023,122 6/1991 Boeckmann et al. .
5,033,868 7/1991 Peppiatt .
5,063,644 11/1991 Herrington et al. .
5,067,208 11/1991 Herrington, Jr. et al. .
5,070,583 12/1991 Herrington .
5,088,971 2/1992 Herrington .
5,092,684 3/1992 Weeks .
5,092,831 3/1992 James et al. .
5,100,246 3/1992 La Pierre et al. .
5,112,138 5/1992 Peppiatt .
5,116,301 5/1992 Robinson et al. .
5,121,997 6/1992 LaPierre et al. .
5,129,734 7/1992 Van Erden .
5,131,121 7/1992 Herrington, Jr. et al. .
5,152,613 10/1992 Herrington, Jr. .
5,161,286 11/1992 Herrington, Jr. et al. .
5,186,543 2/1993 Cochran .
5,189,764 3/1993 Herrington et al. .
5,211,482 5/1993 Tilman .
5,224,779 7/1993 Thompson et al. .
5,283,932 2/1994 Richardson et al. .
5,301,394 4/1994 Richardson et al. .
5,301,395 4/1994 Richardson et al. .
5,405,478 4/1995 Richardson et al. .
5,425,825 6/1995 Rasko et al. .
5,426,830 6/1995 Richardson et al. .
5,431,760 7/1995 Donovan .
5,435,864 7/1995 Machacek et al. .
5,442,837 8/1995 Morgan .
5,442,838 8/1995 Richardson et al. .
5,448,807 9/1995 Herrington, Jr. .
5,448,808 9/1995 Gross .
5,456,928 10/1995 Hustad et al. .
5,482,375 1/1996 Richardson et al. .
5,669,715 9/1997 Dobreski et al. .
5,682,730 11/1997 Dobreski .

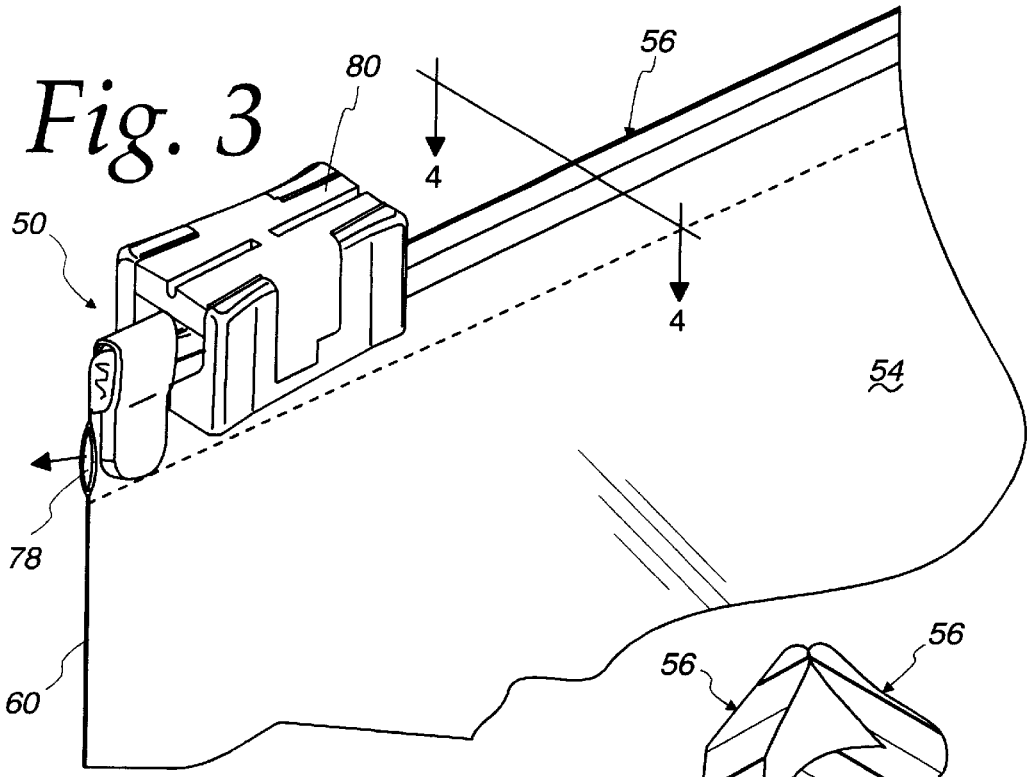
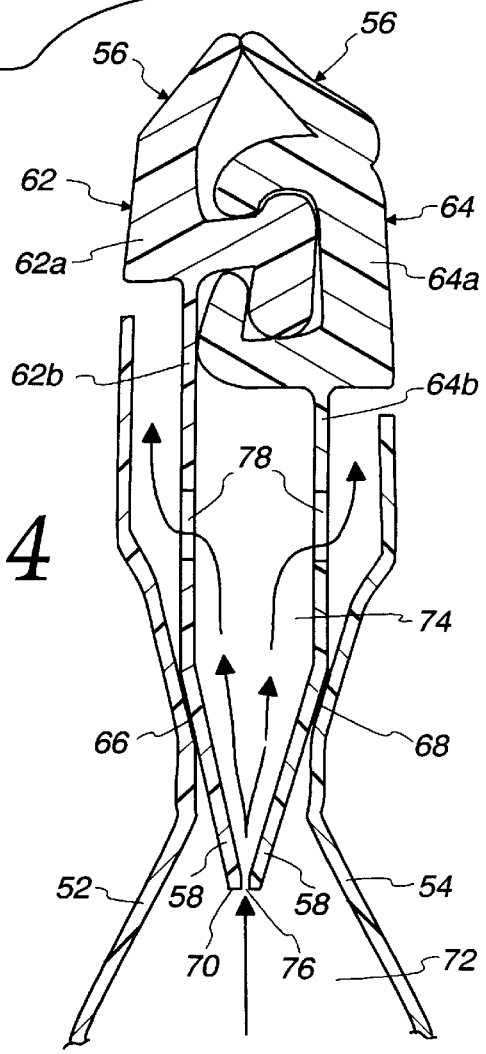
Fig. 4

VENTED RECLOSABLE BAG

FIELD OF THE INVENTION

The present invention relates generally to reclosable bags and, more particularly, relates to a vented reclosable bag that is uncomplicated in construction and easy to operate.

BACKGROUND OF THE INVENTION

Reclosable bags are very common, especially in the food industry. Such bags are typically made to be reclosable via the use of a reclosable feature such as a resealable adhesive seal or a reclosable zipper. Such zippers can be opened and closed either by pressure or by the use of an auxiliary slider mechanism. Reclosable bags are a great convenience to the consumer especially for products where only a portion of the product is typically used at any given time. If these reclosable bags are packaged with a product prior to purchase by consumers, it is desirable to provide the bags with a tamper-evident feature to prevent such bags from being tampered with prior to purchase.

Bags, particularly in the pet food industry, need to be vented to allow air to escape upon stacking or palletizing the bags. A typical bag includes opposing top and bottom ends and a pair of opposing side seals. The top and bottom ends extend between and are perpendicular to the side seals. The top end of the bag forms a mouth through which a consumer can gain access to the product within the bag. Bag suppliers may make a vent or vents in the top end, bottom end, or opposing side seals of the bag for air to escape.

An example of a prior art vented reclosable bag is depicted in FIG. 1. The bag 10 includes a top end 12, an opposing bottom end (not shown), and a pair of opposing side seals 16 and 18. The top end 12 is formed by primary and secondary parallel heat seals 12*a* and 12*b*. To allow air to escape upon stacking or palletizing the bag 10, the primary heat seal 12*a* is interrupted by a central vent 20 while the secondary heat seal 12*b* is interrupted by a pair of off-center vents 22 and 24. Misaligning the central vent 20 relative to the off-center vents 22 and 24 creates a tortuous path that makes it somewhat difficult for bugs to access the product within the bag 10. The bag 10 includes a tamper-evident feature in that a front panel 26 of the bag 10 must be cut with a cutting tool along cut line 28 to gain access to the product within the bag 10. After opening the bag 10, the bag 10 is reclosed by peeling off a resealable adhesive tab 30 up to the arrows in FIG. 1, rolling/folding the top end 12 of the bag 10 two or three times, and placing the peeled-off adhesive tab 30 over the rolled top end 12 and pressing down firmly. The resealed bag 10 is depicted in FIG. 2. The adhesive tab 30 maintains the top end 12 of the bag 10 in rolled form to close the bag 10.

While the reclosable bag 10 in FIGS. 1 and 2 is vented and tamper-evident, the bag 10 is unnecessarily complicated in construction and difficult to operate. To break the tamper-evident feature and open the bag 10, a user requires a cutting tool such as a scissors and must be careful to cut only the front panel 26 of the bag 10 along cut line 28 and not cut the back panel. To reclose the bag 10, the user must perform the above-described steps involving careful digital manipulation of the adhesive tab 30 and the top end 12 of the bag 10. As for the vents 20, 22, and 24, they do allow air to escape upon stacking or palletizing of the bag 10. However, bugs are still capable of maneuvering the tortuous path created by the vents and entering the bag 10.

SUMMARY OF THE INVENTION

In one embodiment, a reclosable bag comprises a pair of opposing wall panels, a reclosable seal, and an optional tamper-evident partition. The pair of opposing wall panels are joined along a pair of opposing sides and a bottom bridging the opposing sides to create a receptacle space having a mouth end opposite the bottom.

The reclosable seal extends along the mouth end and includes first and second opposing reclosable elements. The reclosable seal includes first and second fins extending downward from the respective first and second reclosable elements. The first and second reclosable elements are releasably engageable to each other. The first and second fins are connected to the respective opposing wall panels.

The tamper-evident partition is located below the first and second reclosable elements and forms a one-time breakable preferential area of weakness. The tamper-evident partition separates an interior of the bag from a first area bounded in cross-section by the tamper-evident partition, the first and second fins, and the engaged first and second reclosable elements. The tamper-evident partition includes one or more first vents positioned to allow air from the interior of the bag to escape into the first area. At least one of the first and second fins includes one or more second vents allowing air from the first area to escape to a second area outside the bag.

If the tamper-evident partition is not required, the first vents are eliminated, and the second vents may be located in either the fins or the wall panels and concealed to inhibit entry of bugs into the bag via the vents.

BRIEF DESCRIPTION OF THE DRAWINGS

Other objects and advantages of the invention will become apparent upon reading the following detailed description and upon reference to the drawings in which:

FIG. 3 is an isometric view of a mouth portion of a reclosable bag in accordance with one embodiment of the present invention;

FIG. 4 is a sectional view taken generally along line 4—4 in FIG. 3;

Figure 1:
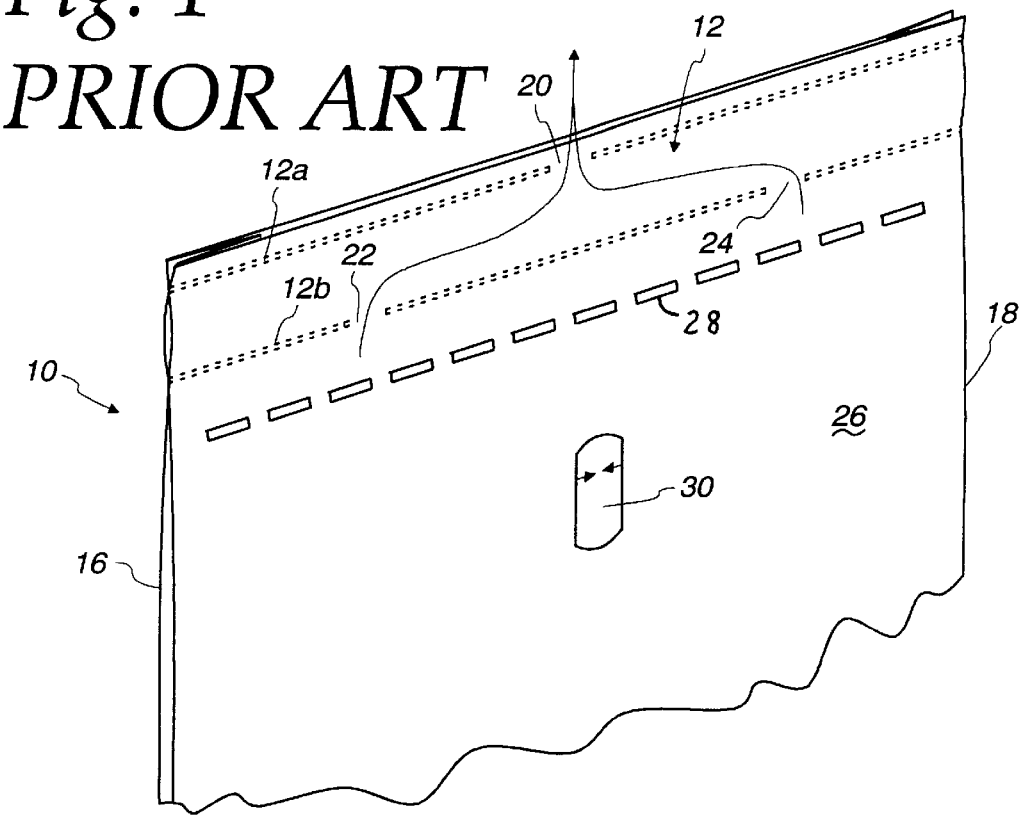
Fig. 1 PRIOR ART
FIG. 1 is an isometric view of a prior art vented reclosable bag before it has been initially opened by breaking its tamper-evident feature.
Figure 2:
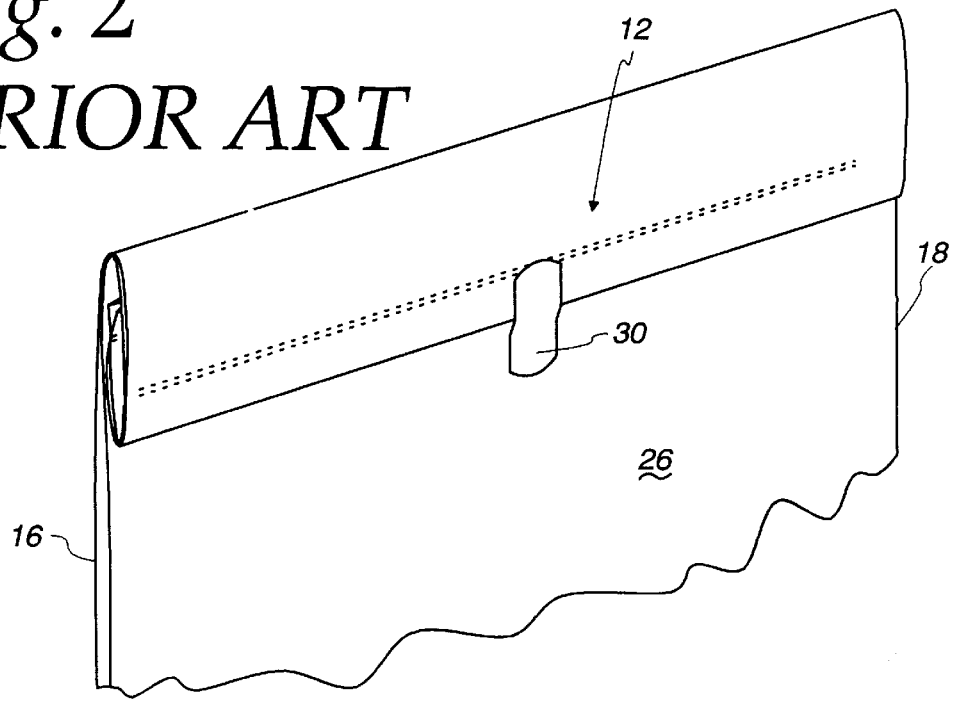
Fig. 2 PRIOR ART
FIG. 2 is an isometric view of the prior art bag in FIG. 1 after it has been resealed by rolling a top end of the bag and securing the rolled top end with a resealable adhesive tab.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIGS. 3 and 4 depict a mouth portion of a reclosable bag 50 embodying the present invention. The reclosable bag 50 comprises a pair of opposing wall panels 52 and 54, a reclosable seal 56, and an optional tamper-evident partition 58. The tamper-evident partition 58 is preferred in those situations where the bag 50 is packaged with a food product prior to purchase by consumers. The pair of opposing wall panels 52 and 54 are joined along a pair of opposing sides 60 (only one shown in FIG. 3) and a bottom (not shown) bridging the opposing sides 60 to create a receptacle space having a mouth end opposite the bottom.

The reclosable seal 56 extends along the mouth end and has first and second opposing tracks 62 and 64. The first track 62 includes a first reclosable element 62*a* and a first fin 62*b* extending downward from the first reclosable element 62*a*. The second track 64 includes a second reclosable element 64*a* and a second fin 64*b* extending downward from the second reclosable element 64*a*. The first and second reclosable elements 62*a* and 64*a* are releasably engageable to each other. The first and second fins 62*b* and 64*b* are connected to the respective opposing wall panels 52 and 54 by respective first and second fin seals 66 and 68. The first and second fin seals 66 and 68 extend between the opposing sides 60 of the bag 50.

The tamper-evident partition 58 forms a one-time breakable preferential area of weakness or preferential tear area 70. Since tamper-evident partition 58 is located below the first and second reclosable elements 62*a* and 64*a*, the operation of the reclosable seal is not hampered by the presence of the tamper-evident partition 58. The tamper-evident partition 58 separates an interior 72 of the bag 50 from an area 74 bounded in cross-section by the tamper-evident partition 58, the first and second fins 62*b* and 64*b*, and the engaged first and second reclosable elements 62*a* and 64*a*. The tamper-evident partition 58 includes one or more first vents 76 positioned to allow air from the interior 72 of the bag 50 to escape into the area 74. At least one of the first and second fins 62*b* and 64*b* includes one or more second vents 78 allowing air from the area 74 to escape to the exterior of the bag 50. The escape of air from the bag interior 72 to the area 74 and then to the exterior of the bag 50 is shown by arrows in FIG. 4.

In the embodiment depicted in FIGS. 3 and 4, the tamper-evident partition 58 is formed by lower portions of the first and second fins 62*b* and 64*b*. Lowermost edges of the fins 62*b* and 64*b* are joined to each other along the preferential area of weakness 70, which can take the form of a perforated line, score line, or thinned line. A score line is created by making a uniform crease at the intersection of the fins 62*b* and 64*b*. A thinned line is created by extruding the fins 62*b* and 64*b* with less plastic material along the region joining the lowermost edges of the fins 62*b* and 64*b*. In another embodiment, the preferential area of weakness 70 results from forming the fins 62*b* and 64*b* as a single continuous body out of highly oriented plastic that has a tendency to split along the preferential area of weakness 70. Instead of extruding the fins 62*b* and 64*b* as a single continuous body, the fins may be separately extruded and then later weakly attached at their lower edges or some other location by heat sealing, welding, or the like. The weak attachment of the fins 62*b* and 64*b* creates the preferential area of weakness 70.

The first and second fins 62*b* and 64*b* in FIG. 4 are connected to inner surfaces of the respective opposing wall panels 52 and 54 by the respective first and second fin seals 66 and 68. To make it virtually impossible for bugs to find their way into the bag 50, the wall panel 52 extends above and thereby conceals any of the second vents 78 formed in the first fin 62*b*. Likewise, the wall panel 54 extends above and thereby conceals any of the second vents 78 formed in the second fin 64*b*.

The first and second reclosable elements 62*a* and 64*a* preferably take the form of interlocking profiles operated by an auxiliary slider mechanism 80 (FIG. 3). The slider mechanism 80 is slidably mounted to the reclosable elements 62*a* and 64*a* for movement between a closed position and an open position. The reclosable elements are engaged to each other while the slider mechanism 80 is in the closed position, and movement of the slider mechanism 80 from the closed position to the open position disengages the reclosable elements from each other. The composition and manner of operation of the reclosable seal and slider arrangement is described in detail in U.S. Pat. No. 5,067,208 to Herrington, Jr. et. al., which is incorporated herein by reference in its entirety. In an alternative embodiment, the slider mechanism 80 is eliminated, and the reclosable elements 62*a* and 64*a* take the form of profiled zipper elements operated by digital pressure or take the form of resealable adhesive members.

In order to open the reclosable bag 50, a consumer grips the slider mechanism 80 and moves it such that the reclosable elements 62*a* and 64*a* are disengaged from each other. Next, the consumer tears open the tamper evident partition 58 along the preferential area of weakness 70 joining the lowermost edges of the fins 62*b* and 64*b*. The bag 50 can be resealed utilizing the reclosable elements 62*a* and 64*a* and slider mechanism 80. Specifically, the consumer grips the slider mechanism 80 and moves it from the open position to the closed position so as to engage the complementary closure profiles.

Figure 5:
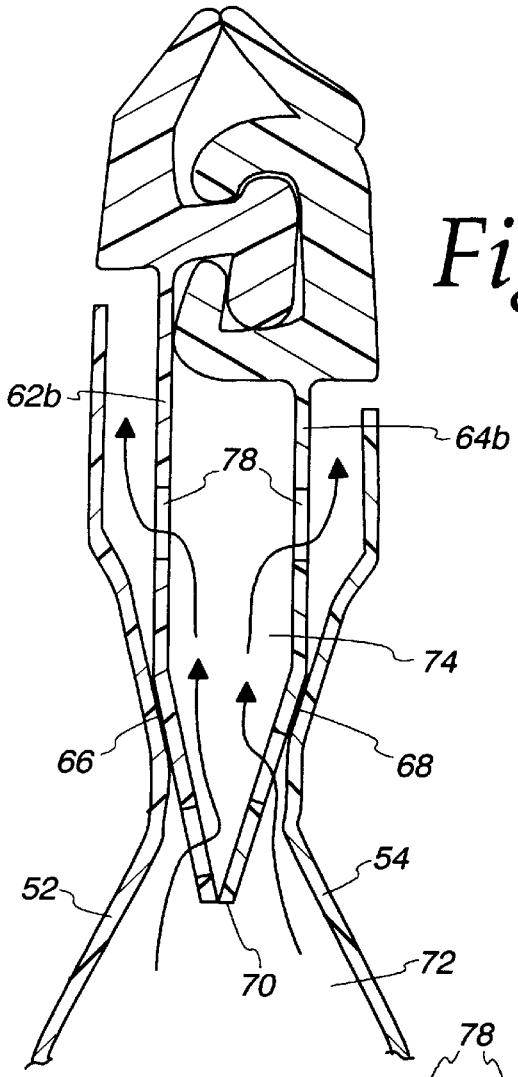
FIG. 5 is a sectional view similar to that in FIG. 4 showing an alternative arrangement of vents for allowing air to escape upon stacking or palletizing the bag.

To allow air to escape upon stacking or palletizing the bag 50, the bag 50 includes the first vents 76 and the second vents 78. The first vents 76 may be intermittently located along the preferential area of weakness 70 (FIG. 4) or away from the preferential area of weakness (FIG. 5). The first vents 76 are located below the fin seals 66 and 68 and communicatively couple the interior 72 of the bag to the area 74 between the first and second fins 62*b* and 64*b*. The second vents 78 are located above the fin seals 66 and 68 and communicatively couple the area 74 to the exterior of the bag 50.

Figure 6:
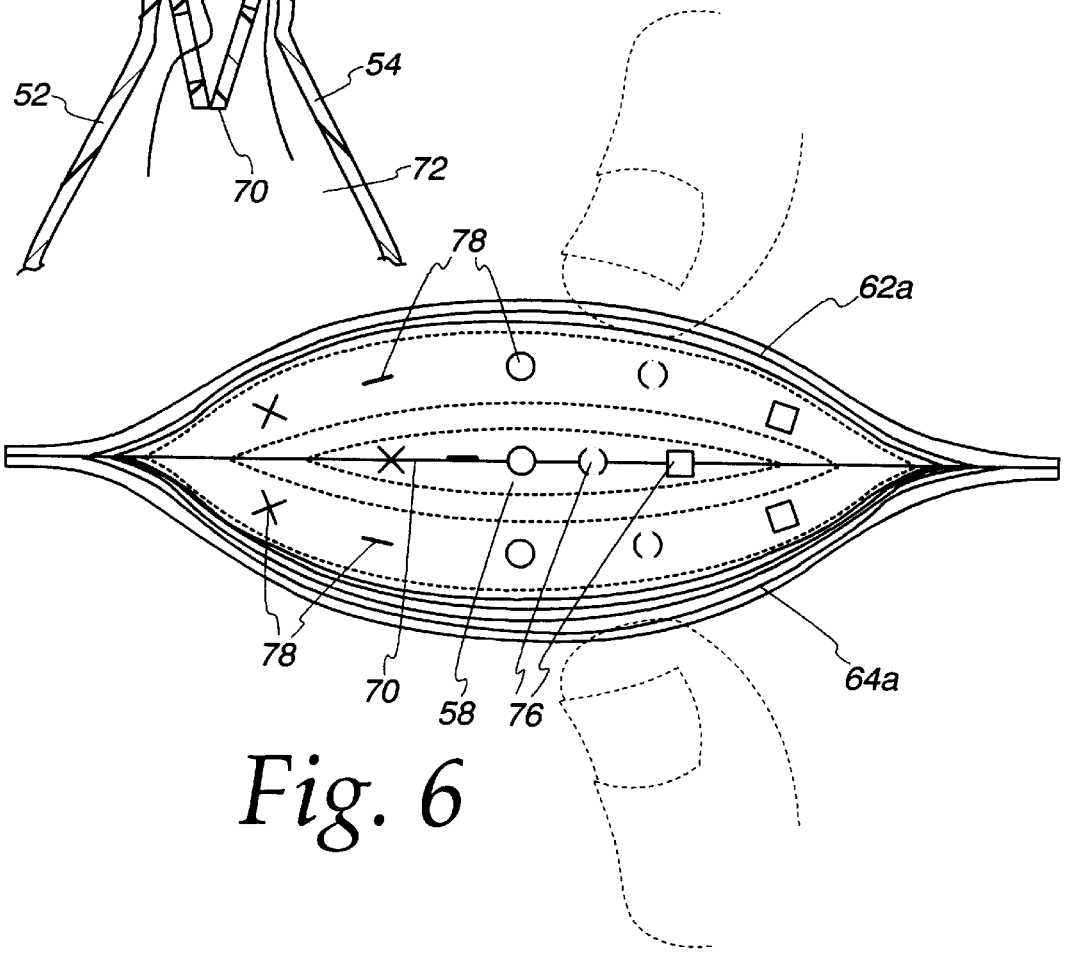
FIG. 6 is a top view of the opened mouth portion of the bag showing examples of alternative configurations of the vents formed in the fins of the reclosable seal.

FIG. 6 depicts a top view of the bag 50 showing the reclosable elements 62*a* and 64*a* disengaged from each other but with the tamper-evident partition 58 still intact. As shown in FIG. 6, the first and second vents 76 and 78 may take on various shapes, including but not limited to linear slits, intersecting/crossed linear slits, curved slits, circular cutouts, and polygonal cutouts. The use of slits and crossed slits is especially desirable because they serve as valves that allow air to escape but prevent bugs from entering therethrough. Although FIG. 6 depicts all of these shapes, it is preferable to use a single shape for the first vents 76 and a single shape for the second vents 78. The second vents 78 may be shaped differently than the first vents 76. As shown in FIG. 3, the second vents 78 may simply take the form of a discontinuity (e.g., slits or cutouts) located along the opposing sides 60 above the fin seals.

Figure 7:
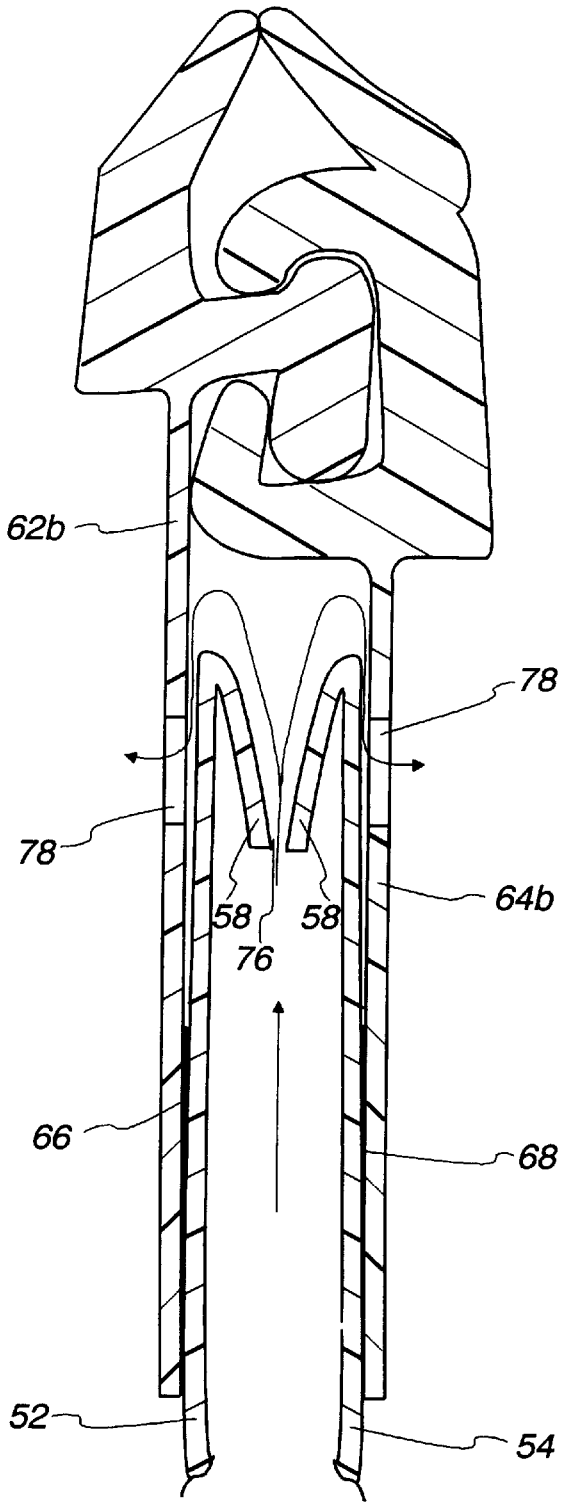
FIG. 7 is a sectional view of a mouth portion of a reclosable bag in accordance with another embodiment of the present invention.

Referring now to FIG. 7, where like reference numerals are used to identify analogous parts, there is shown a reclosable bag in accordance with an alternative embodiment of the present invention. In the bag of FIG. 7, the first and second fins 62*b* and 64*b* are connected to outer surfaces of the respective opposing wall panels 52 and 54 by the respective first and second fin seals 66 and 68. Instead of being formed by the fins, the tamper-evident partition 58 is created by integral gusset-forming extensions of the wall panels 52 and 54. To make it virtually impossible for bugs to find their way into the bag, the wall panel 52 extends above and thereby conceals the second vents 78 formed in the first fin 62*b*. Likewise, the wall panel 54 extends above and thereby conceals the second vents 78 formed in the second fin 64*b*.

Figure 8:
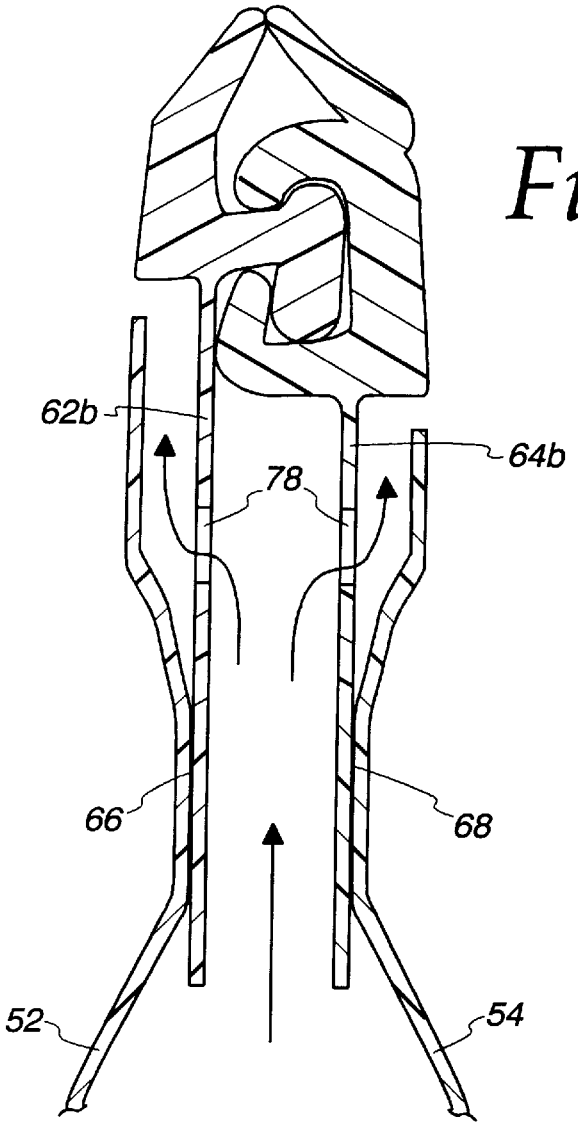
FIG. 8 is a sectional view of a mouth portion of a reclosable bag like that in FIGS. 4 and 5, but without a tamper-evident feature.
Figure 9:
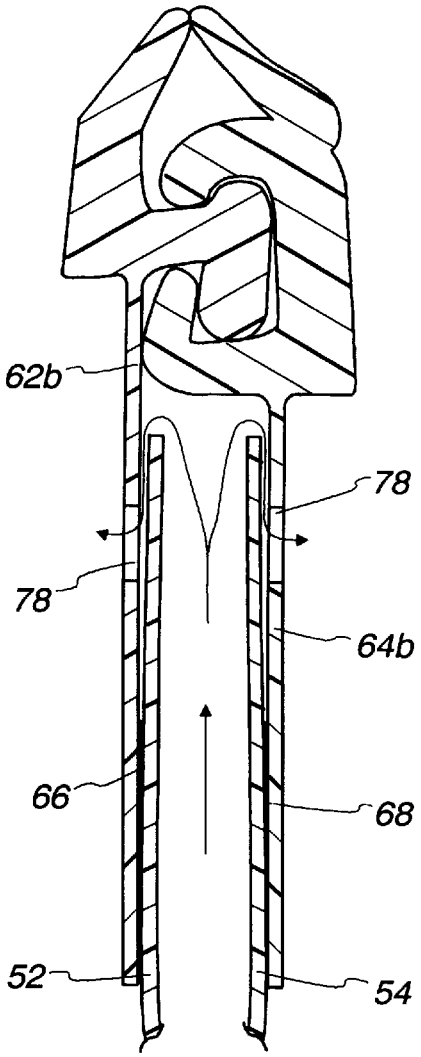
FIG. 9 is a sectional view of a mouth portion of a reclosable bag like that in FIG. 7, but without a tamper-evident feature.

In situations where a tamper-evident feature is not required, the bags of FIGS. 3–7 may be modified to eliminate the tamper-evident partition 58 and its vents 76. FIG. 8 illustrates a bag like that of FIGS. 4 and 5, but without the tamper-evident partition 58. FIG. 9 illustrates a bag like that of FIG. 7, but without the tamper-evident partition 58. In both FIGS. 8 and 9 the vents 78 in the fins 62*b* and 64*b* allow air to escape upon stacking or palletizing the bag, and the extension of the wall panels 52 and 54 above the vents 78 inhibits bugs from entering the bag. The vents 78 formed in the fin 62*b* are located above the fin seal 66 but below the upper end of the wall panel 52, and the vents 78 formed in the fin 64*b* are located above the fin seal 68 but below the upper end of the wall panel 54.

Figure 10:
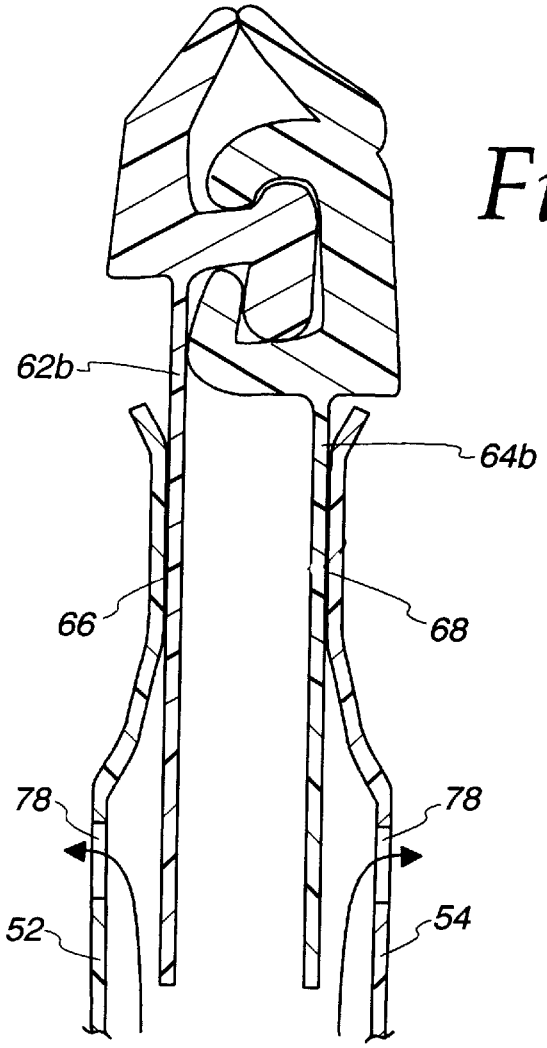
FIG. 10 is a sectional view similar to that of FIG. 8, but with the vents located on the bag wall panels instead of the fins of the reclosable seal.
Figure 11:
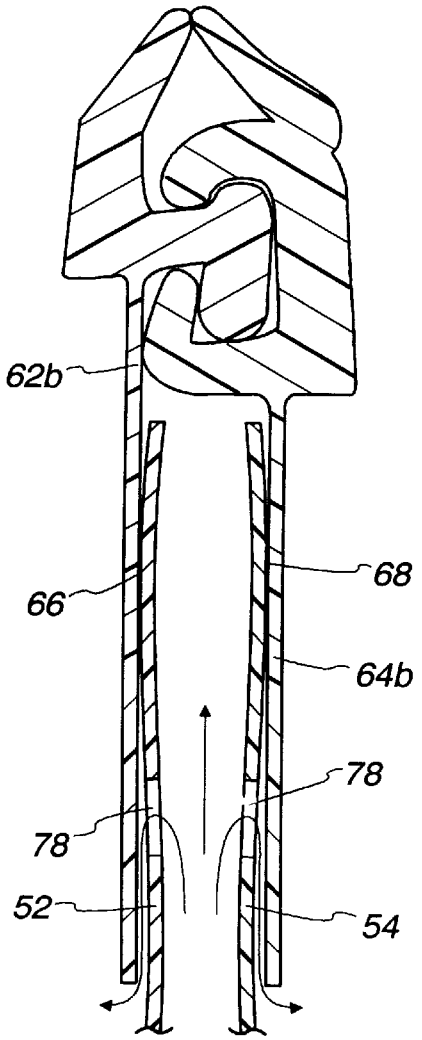
FIG. 11 is a sectional view similar to that of FIG. 9, but with the vents located on the bag wall panels instead of the fins of the reclosable seal.

As shown in FIGS. 10 and 11, the vents 78 may be located on the bag wall panels 52 and 54 instead of the fins 62*b* and 64*b* of the reclosable seal. In this case, the fins 62*b* and 64*b* are extended downward by a sufficient distance from the reclosable elements to overlap the vents 78, thereby inhibiting bugs from entering the bag. The vents 78 formed in the wall panel 52 are located below the fin seal 66 but above the lower end of the fin 62*b*, and the vents 78 formed in the wall panel 54 are located below the fin seal 68 but above the lower end of the fin 64*b*.

The vented reclosable bags in FIGS. 3–11 are uncomplicated in construction and easy to operate. The vents 76 and 78 effectively allow air to escape upon stacking or palletizing the bag, and make it virtually impossible for bugs to find their way into the bag. If the bag includes a tamper-evident feature, a user can easily break the tamper-evident feature and open the bag by disengaging the reclosable elements 62*a* and 64*a* using the slider mechanism 80 and pulling the zipper tracks 62 and 64 in opposite directions until the partition 58 ruptures along the preferential area of weakness 70. No cutting tools are required. To reclose the bag, the user can easily re-engage the reclosable elements 62*a* and 64*a* using the slider mechanism 80.

The reclosable seal 56, optional tamper-evident partition 58, and optional slider mechanism 80 are optimally made from polyethylene, polypropylene, or copolymers of polyethylene or polypropylene. Especially preferred components are low density polyethylene (LDPE) for the reclosable seal 56 and tamper-evident partition 58 and polypropylene for the slider mechanism 80.

The films making up the opposing wall panels of the polymeric bag typically are made of polyethylene, polypropylene, polyester, copolyester or mixtures of those compositions. Furthermore, the polymeric bag can have multiple layers joined by coextrusion. Thus, one skilled in the art can design and coextrude multi-layered polymeric bags which will incorporate the various properties inherent in differing polyethylene and polypropylene compositions. It is further possible to incorporate pigments, metallic components, paper, and/or paper/plastic composites into or on the layer or layers of the polymeric bag.

The components of the reclosable seal 56 such as the zipper tracks 62 and 64 may be attached to the wall panels 52 and 54 of the bag by the processes of either heat sealing or welding. The process utilized depends upon the materials from which the bag and reclosable seal are made. Specifically, heat sealing is a process whereby similar polymeric-based materials are fused or melted together. Welding is a process where an intermediate third material such as an adhesive is utilized to "glue" dissimilar polymeric-based materials to each other.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable bag, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the reclosable seal including first and second fills extending downward from the respective first and second reclosable elements, the first and second reclosable elements being releasably engageable to each other, the first and second fins being connected to the respective opposing wall panels by respective first and second fin seals; and a tamper-evident partition below the first and second reclosable elements and forming a one-time breakable preferential area of weakness, the tamper-evident partition separating a first interior area of the bag from a second interior area bounded in cross-section by the tamper-evident partition, the first and second fins, and the engaged first and second reclosable elements, the tamper-evident partition including one or more first vents positioned to allow air from the first interior area of the bag to escape into the second interior area, at least one of the first and second fins including one or more second vents located above the respective fin seal allowing air from the second interior area to escape to an exterior of the bag.

2. The reclosable bag of claim 1, wherein the first and second fins are joined to each other, the tamper-evident partition being formed by the first and second fins.

3. The reclosable bag of claim 2, wherein the first and second fins are connected to inner surfaces of the respective opposing wall panels by the respective first and second fin seals.

4. The reclosable bag of claim 3, wherein the wall panel connected to the first fin extends above and thereby conceals any of the second vents formed in the first fin, and wherein the wall panel connected to the second fin extends above and thereby conceals any of the second vents formed in the second fin.

5. The reclosable bag of claim 1, wherein the first vents are located along the preferential area of weakness.

6. The reclosable bag of claim 1, wherein the first vents are located away from the preferential area of weakness.

7. The reclosable bag of claim 1, wherein the first and second vents have a shape selected from a group consisting of a slit, a pair of intersecting slits, a circular cutout, and a polygonal cutout.

8. The reclosable bag of claim 1, wherein the first reclosable element includes a first locking profile and the second reclosable element includes a second locking profile, and further including a slider mechanism slidably mounted to the first and second profiles for movement between a closed position and an open position, the first and second profiles being engaged to each other while the slider mechanism is in the closed position, the first and second profiles being disengaged from each other in response to movement of the slider mechanism to the open position.

9. The reclosable bag of claim 1, wherein the one or more second vents are located along at least one of the opposing sides.

10. The reclosable bag of claim 1, wherein the first and second fins are joined to each other along respective lower edges thereof, and the first vents are intermittently located along a junction of the first and second fins.

11. The reclosable bag of claim 1, wherein the first vents are intermittently located along one of the first and second fins away from a junction of the first and second fins.

12. The reclosable bag of claim 1, wherein the first and second fins are connected to outer surfaces of the respective opposing wall panels by the respective first and second fin seals, said tamper-evident partition being formed by integral extensions of the wall panels.

13. The reclosable bag of claim 12 wherein the wall panel connected to the first fin extends above any of the second vents formed in the first fin, and wherein the wall panel connected to the second fin extends above any of the second vents formed in the second fin.

14. A reclosable bag, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the reclosable seal including first and second fins extending downward from the respective first and second reclosable elements, the first and second reclosable elements being releasably engageable to each other, the first and second fins being connected to the respective opposing wall panels by respective first and second fin seals; and a tamper-evident partition below the first and second reclosable elements and forming a one-time breakable preferential area of weakness, the tamper-evident partition separating a first interior area of the bag from a second interior area bounded in cross-section by the tamper-evident partition, the first and second fins, and the engaged first and second reclosable elements, the tamper-evident partition including one or more first vents communicatively coupling the first interior area of the bag to the second interior area, at least one of the first and second fins including one or more second vents loaded above the respective fin seal communicatively coupling the second interior area to an exterior of the bag.

15. The reclosable bag of claim 14 herein the first vents are located below at least one of the fin seals.

16. A reclosable bag comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the reclosable seal including first and second fins extending downward from the respective first and second reclosable elements, the first and second reclosable elements being releasably engageable to each other, the first and second fins being connected to inner surfaces of the respective opposing wall panels by respective first and second fin seals, at least one of the first and second fins including one or more vests allowing air to escape from an interior to an exterior of the bag, the wall panel connected to the first fin overlapping any of the vents formed in the first fin, the wall panel connected to the second fin overlapping any of the vents formed in the second fin, any of the vents formed in the first fin being located above the first fin seal, any of the vents formed in the second fin being located above the second fin seal.

17. A reclosable bag, comprising:

first and second opposing wall panels joined along a pair of opposing sides and a bottom bridging the opposing sides to create a receptacle space having a mouth end opposite the bottom; and a reclosable seal extending along the mouth end and including first and second opposing reclosable elements, the reclosable seal including first and second fins extending downward from the respective first and second reclosable elements, the first and second reclosable elements being releasably engageable to each other, the first and second fins being connected to the respective first and second wall panels by respective first and second fin seals, at least one of the the first and second fins including one or more first vents located above the respective fin seal allowing air to escape from an interior to an exterior of the bag, the first wall panel overlapping any of the first vents formed in the first fin, the second wall panel overlapping any of the first vents formed in the second fin.

18. The reclosable bag of claim 17 wherein the first and second fins are joined to each other to form a tamper-evident partition below the first and second reclosable elements, the tamper-evident partition separating a main interior of the bag from a mouth interior area bounded in cross-section by the tamper-evident partition, the first and second fins, and the engaged first and second reclosable elements, the tamper-evident partition including one or more second vents positioned to allow air from the main interior of the bag to escape into the mouth interior area, the first vents allowing air from the mouth interior area to escape to the exterior of the bag.

19. The reclosable bag of claim 17 wherein the first and second fins are connected to outer surfaces of the respective first and second wall panels.

20. The reclosable bag of claim 19 further including integral extensions of the respective first and second wall panels, said integral extensions being joined to each other to form a tamper-evident partition below the first and second reclosable elements, the tamper-evident partition separating the interior of the bag from a mouth area bounded in cross-section by the tamper-evident partition, the first and second fins, and the engaged first and second reclosable elements, the tamper-evident partition including one or more second vents positioned to allow air from the interior of the bag to escape into the mouth area, the first vents allowing air from the mouth area to escape to the exterior of the bag.

* * * * *

UNITED STATES PATENT AND TRADEMARK OFFICE

CERTIFICATE OF CORRECTION

PATENT NO. : 5,911,508

DATED : June 15, 1999

INVENTOR(S) : David V. Dobreski et al.

It is certified that error appears in the above-indentified patent and that said Letters Patent is hereby corrected as shown below:

In column 6, line 21, "fills" should be --fins--.
In column 8, line 6, "vests" should be --vents--.

Signed and Sealed this

Twenty-sixth Day of October, 1999

*Attest:*

Q. TODD DICKINSON

*Attesting Officer*

*Acting Commissioner of Patents and Trademarks*